United States Patent [19]

Matsumura et al.

[11] 4,444,168

[45] Apr. 24, 1984

[54] ENGINE IDLING SPEED CONTROL METHOD AND APPARATUS

[75] Inventors: Toshimi Matsumura, Oobu; Norio Omori, Kariya, both of Japan

[73] Assignee: Nippondenso Co., Ltd., Kariya, Japan

[21] Appl. No.: 343,366

[22] Filed: Jan. 27, 1982

[30] Foreign Application Priority Data

Jan. 29, 1981 [JP] Japan ..... 56-12121

[51] Int. Cl.[3] ..... F02D 1/04

[52] U.S. Cl. ..... 123/339; 123/340; 123/179 B; 123/179 G

[58] Field of Search ..... 123/339, 340, 179 B, 123/179 G

[56] References Cited

U.S. PATENT DOCUMENTS

| | | | |
|---|---|---|---|
| 3,964,457 | 6/1976 | Coscia | 123/339 |
| 4,191,051 | 3/1980 | Kawata et al. | 123/339 |
| 4,203,395 | 5/1980 | Cromas et al. | 123/339 |
| 4,237,833 | 12/1980 | Des Lauriers | 123/339 |
| 4,237,838 | 12/1980 | Kinugawa et al. | 123/339 |
| 4,289,100 | 9/1981 | Kinugawa et al. | 123/339 |
| 4,344,399 | 8/1982 | Matsumura et al. | 123/339 |
| 4,359,983 | 11/1982 | Carlson et al. | 123/339 |
| 4,378,768 | 4/1983 | Itoh et al. | 123/339 |

*Primary Examiner*—Raymond A. Nelli

*Attorney, Agent, or Firm*—Cushman, Darby & Cushman

[57] ABSTRACT

An engine speed control method and apparatus employs at least two basic control variable maps comprising a first basic control variable map for determining the desired air flow to an internal combustion engine in accordance with the warming conditions of the engine during the starting period and a second basic control variable map for determining the desired air flow in accordance with the warming conditions of the engine after the starting period, and the maps are used selectively in accordance with the warming conditions of the engine. Upon change-over from the control according to one map to the control according to the other map, the air flow is varied gradually at intervals of predetermined engine revolutions or a predetermined period of time so as to effect the change-over to the control according to the desired map. During the idling operation after the engine has been warmed up sufficiently, the difference between each of the desired idling speeds preliminarily established in correspondence to the operating conditions of the engine and the actual idling speed is detected and the required correction values of the basic control variable for controlling the air flow are computed and stored thereby controlling the idling speed of the engine.

6 Claims, 7 Drawing Figures

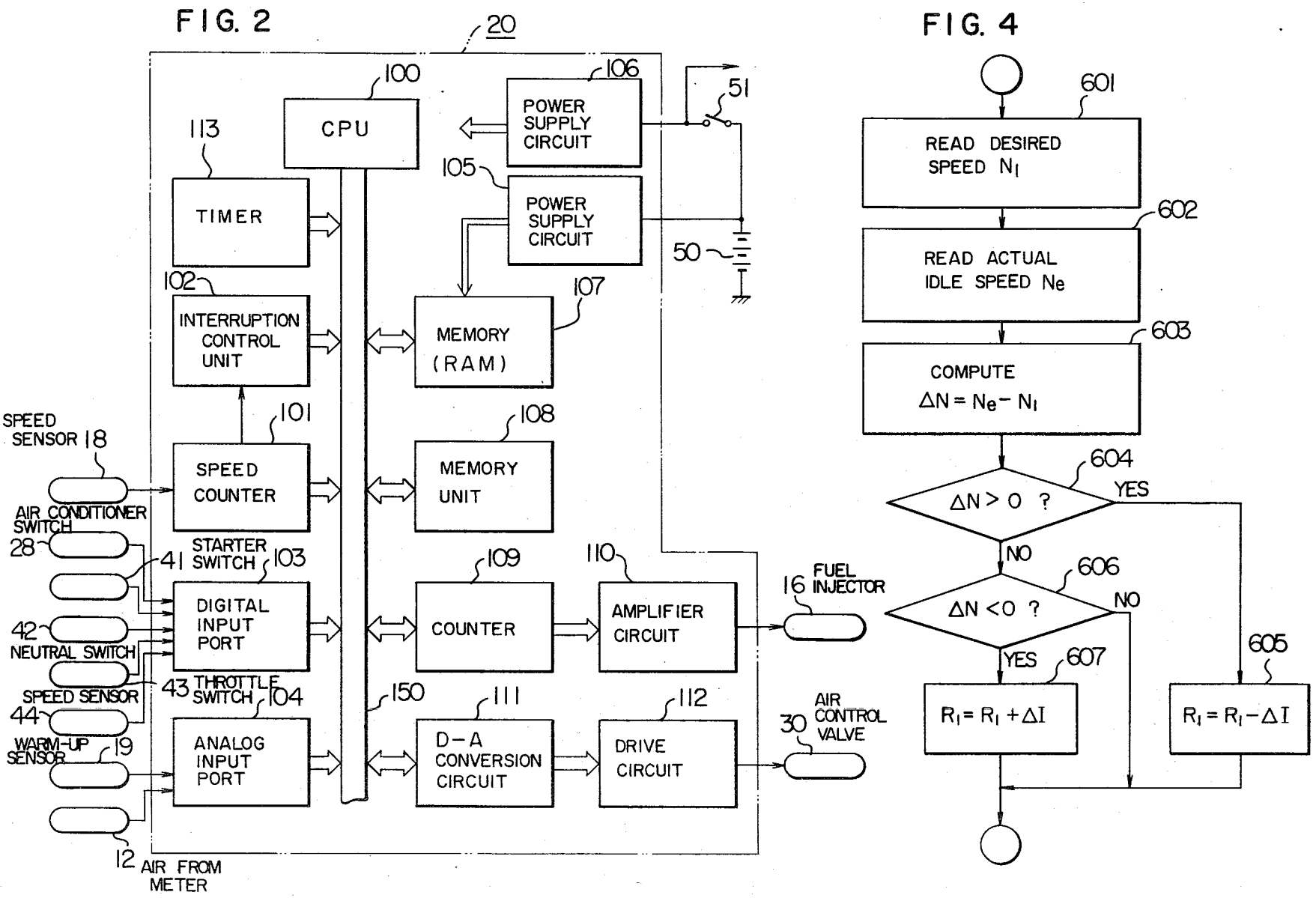
FIG. 4
601
READ DESIRED SPEED $N_I$
602
READ ACTUAL IDLE SPEED Ne
603
COMPUTE $\Delta N = N_e - N_I$
604
$\Delta N > 0$ ?
YES
NO
605
$R_I = R_I - \Delta I$
606
$\Delta N < 0$ ?
NO
YES
607
$R_I = R_I + \Delta I$
FIG. 2
20
100
CPU
113
TIMER
102
INTERRUPTION CONTROL UNIT
101
SPEED COUNTER
103
STARTER SWITCH
41
DIGITAL INPUT PORT
43
THROTTLE SWITCH
104
ANALOG INPUT PORT
150
105
POWER SUPPLY CIRCUIT
106
POWER SUPPLY CIRCUIT
107
MEMORY (RAM)
108
MEMORY UNIT
109
COUNTER
110
AMPLIFIER CIRCUIT
111
D-A CONVERSION CIRCUIT
112
DRIVE CIRCUIT
50
51
16
FUEL INJECTOR
30
AIR CONTROL VALVE
18
SPEED SENSOR
28
AIR CONDITIONER SWITCH
42
NEUTRAL SWITCH
44
SPEED SENSOR
19
WARM-UP SENSOR
12
AIR FROM METER

ENGINE IDLING SPEED CONTROL METHOD AND APPARATUS

BACKGROUND OF THE INVENTION

The present invention relates to a method and apparatus for controlling the idling speed of an internal combustion engine during the starting operation and warm-up period of the engine.

In the past, various control methods have been proposed in which a basic control variable is preliminarily established to control the idle air flow to the engine for controlling idling speed of the engine according to the engine warm-up conditions such as the cooling water temperatures and the idle air flow is adjusted in accordance with the basic control variable. However, since these known methods are designed so that during the warm-up period a control variable is unambiguously derived from a single map in accordance with the warming condition of the engine and the control variable is outputted to effect an open-loop control of the idling speed, this type of control finds it difficult to adapt the control to the required starting and warm-up characteristics of the engine and thus various problems still remain unsolved. For instance, one type of generating a fixed amount of control variable irrespective of engine warm-up conditions in the starting period of the engine undergoes such a problem that the engine speed is increased abnormally if the fixed amount of control variable is generated after the warm-up of the engine has been completed and that the engine speed is not increased quickly leading to the engine stalling in very cold condition. The problem with using only one kind of control variable varying in accordance with the warming conditions during the warm-up period is that it is difficult to effect a control which responds to decrease in the engine frictional torque so that even under the same warming-up condition (or water temperature), lower the starting temperature is, higher the engine speed tends to become thus making it difficult to adapt the engine speed after the starting to the warming conditions of the engine.

SUMMARY OF THE INVENTION

It is the general object of the present invention to provide an engine speed control method and apparatus in which in order to control the air flow to an engine in accordance with the warming conditions of the engine, there are provided at least two different basic control variable supply sources, such as, basic control variable maps or basic control variable calculation formulas which are preliminarily determined in accordance with the preliminarily selected engine conditions, whereby the basic control variable supply sources are used selectively so that during the starting period of the engine the values corresponding to the warming conditions are derived from the first basic control variable supply source and during the warm-up period the values corresponding to the warming conditions are derived from the second basic control variable supply source, and moreover during the change-over between the basic control variable supply sources the value from the first basic control variable supply source is decreased gradually at intervals of predetermined engine revolutions or a predetermined time period to approach the value from the second basic control variable supply source, thereby controlling the air flow to the engine during the starting period in accordance with the starting warming conditions to start the engine smoothly and also providing a degree of freedom for the control during the warm-up period to suit the engine speed to the engine warming conditions and improve the fuel consumption during the warm-up period.

BRIEF DESCRIPTION OF THE DRAWINGS

FIG. 2 is a block diagram of the electronic control unit shown in FIG. 1.

FIG. 4 is a detailed flow chart of the principal part of the flow chart shown in FIG. 3.

DESCRIPTION OF THE PREFERRED EMBODIMENT

Figure 1:
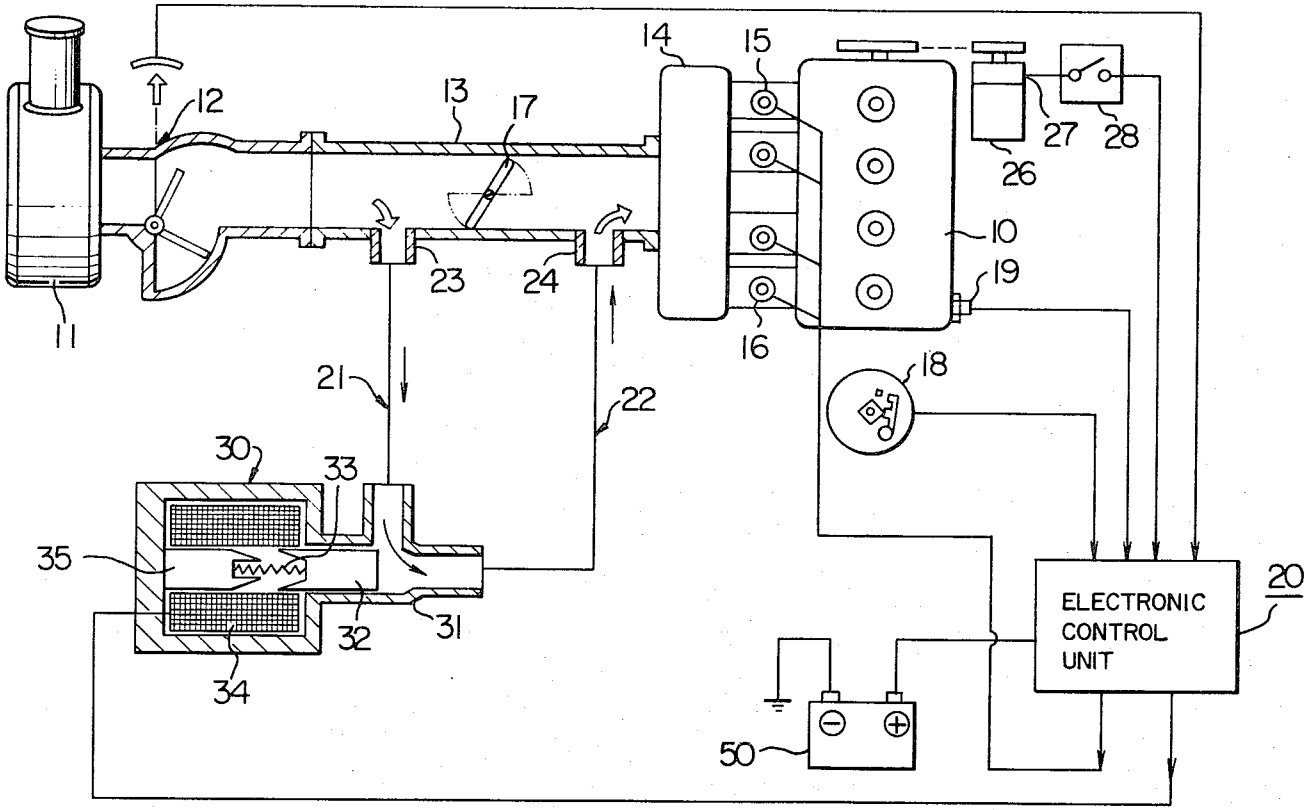
FIG. 1 is a schematic diagram showing the construction of an embodiment of the invention.

Referring to FIG. 1, an engine 10 is a known type of automobile four-cycle spark-ignition engine which is equipped with a vehicle air conditioner and an automatic transmission and engine loads. The engine 10 draws in air via an air cleaner 11, an air flow meter 12, an intake pipe 13, a surge tank 14 and intake branch pipes 15, and the fuel such as gasoline is injected through electromagnetic fuel injector 16 mounted on the intake branch pipes 15.

The main air flow to the engine 10 is adjusted by a throttle valve 17 which is operated arbitrarily and the quantity of fuel injected is adjusted by an electronic control unit 20. The electronic control unit 20 determines the quantity of fuel injected by a known technique using as basic parameters the engine speed measured by an engine speed sensor 18 incorporated in the distributor of an ignition system and the amount of air flow measured by the air flow meter 12, and the fuel injection quantity is varied in known manner in response to the signals from a warm-up sensor 19 comprising a water temperature sensor for sensing the cooling water temperature and others.

Auxiliary an induction pipes 21 and 22 are arranged to bypass the throttle valve 17 and an air control valve 30 is positioned between the pipes 21 and 22. The other end of the pipe 21 is connected to an air inlet port 23 which is positioned between the throttle valve 17 and the air flow meter 12 and the other end of the pipe 22 is connected to an air inlet port 24 which is positioned downstream of the throttle valve 17.

The air control valve 30 is basically a control valve of the linear solenoid type and the air passage area between the pipes 21 and 22 is varied in response to the displacement of a movable plunger 32 which is slidable within a housing 31. Normally the plunger 32 is set by a compression spring 33 so as to reduce the air passage area to zero.

An electromagnetic coil 34 is energized so that an electromagnetic attraction acts between the plunger 32 and a core 35 and the plunger 32 is moved toward the core 35 in dependence on the average value of the current flow.

In this way, the air control valve 30 varies the distance between the plunger 32 and the core 35 in dependence on the current flowing to the coil 34, so that the air passage area between the pipes 21 and 22 is continuously varied and thus the amount of air flow is controlled in accordance with the current value.

The operation of the coil 34 is controlled by the electronic control unit 20 in the like manner as the fuel injector 16. In addition to the signals from the engine speed sensor 18 and the warm-up sensor 19, the electronic control unit 20 receives various other signals including the signal from an air conditioner switch 28 which turns on and off an electromagnetic clutch 27 for coupling and decoupling a compressor 26 of an air conditioner such as the vehicle cooler and the engine drive shaft.

Next, the electronic control unit 20 will be described with reference to FIG. 2. Numeral 100 designates a microprocessor (CPU) which performs the computation of the desired fuel injection quantity and idle air flow in terms of the duration of opening of the fuel injector 16 and the displacement (or the magnitude of the average current flow) of the coil 34 in the air control valve 30. Numeral 101 designates a speed counter for detecting the engine speed in response to the signal from the engine speed (RPM) sensor 18. The speed counter 101 also sends an interruption command signal to an interruption control unit 102 in synchronism with the rotation of the engine. When the command signal is received by the interruption control unit 102, an interruption signal is supplied to the microprocessor 100 via a common bus 150 and thus the microprocessor 100 performs the computation of fuel injection quantity, etc., by a known technique. Numeral 103 designates a digital input port for receiving the signal from the air conditioner switch 28 as well as the signal from a starter switch 41 for turning on and off the operation of the starter which is not shown, the signal from a neutral switch 42 for detecting whether the automatic transmission of the automobile is at the neutral position, the signal from a throttle switch 43 for detecting whether the throttle valve 17 is at the fully closed position (or the idling position) and the signal from a vehicle speed sensor 44 for detecting whether the vehicle has a speed (or whether the vehicle is at rest) and these digital signals are supplied to the microprocessor 100. Numeral 104 designates an analog input port comprising an analog multiplexer and an A-D converter whereby the signal from the cooling water temperature detecting warm-up sensor 19 and the signal from the engine air flow (intake air quantity) detecting air flow meter 12 are successively subjected to A-D conversion and supplied to the microprocessor 100. The output data of these units 101, 102, 103 and 104 are transmitted to the microprocessor 100 through the common bus 150. Numeral 50 designates a battery, and 51 a key switch. A power supply circuit 105 is connected to the battery 50 directly and not through the key switch 51 to supply power to a nonvolatile read/write memory (RAM) 107. As a result, the power supply is always applied to the RAM 107 irrespective of the key switch 51. Numeral 106 designates another power supply circuit connected to the battery 50 through the key switch 51. The power supply circuit 106 supplies the power to the component parts other than the RAM 107. The RAM 107 forms a temporary memory unit which is used temporarily when any program is in operation and the power supply is always applied to the RAM 107 so that its stored contents are not lost even if the key switch 51 is turned off to stop the operation of the engine. The RAM 107 stores correction values R ($R_1$, $R_2$, $R_3$, $R_4$) which will be described later. Numeral 108 designates a memory unit comprising a read-only memory (ROM) for storing various programs, constants, etc., and a read/write memory for temporarily storing data when any program is in operation (when any processing is being performed). The ROM stores data including initial correction values Ii and various maps which will be described later. Numeral 109 designates a fuel injection duration controlling counter including a register and adapted to convert a digital signal indicative of the valve open duration of the electromagnetic fuel injector 16 or the fuel injection quantity computed by the microprocessor (CPU) 100 to a pulse signal of a pulse time width which provides the actual valve open duration of the electromagnetic fuel injector 16. Numeral 110 designates an amplifier circuit for actuating the electromagnetic fuel injection valves. Numeral 111 designates a D-A conversion unit for controlling the idle air flow, whereby a control variable I signal indicative of the magnitude of the current flow to the electromagnetic mechanism 34 which determines the opening of the electromagnetic air control valve 30 or the like air flow computed by the microprocessor 100 is converted to an analog signal, amplified by a known type of drive circuit 112 and used to actuate the air control valve 30. Numeral 113 designates a timer for measuring the elapsed time and transmitting it to the CPU 100. The speed counter 101 is responsive to the output of the engine speed sensor 18 to measure the engine speed once every engine revolution and supply an interruption command signal to the interruption control unit 102 upon completion of the measurement. In response to the command signal, the interruption control unit 102 generates an interruption signal and causes the microprocessor 100 to perform an interruption processing routine for the computation of fuel injection quantity.

Figure 3:
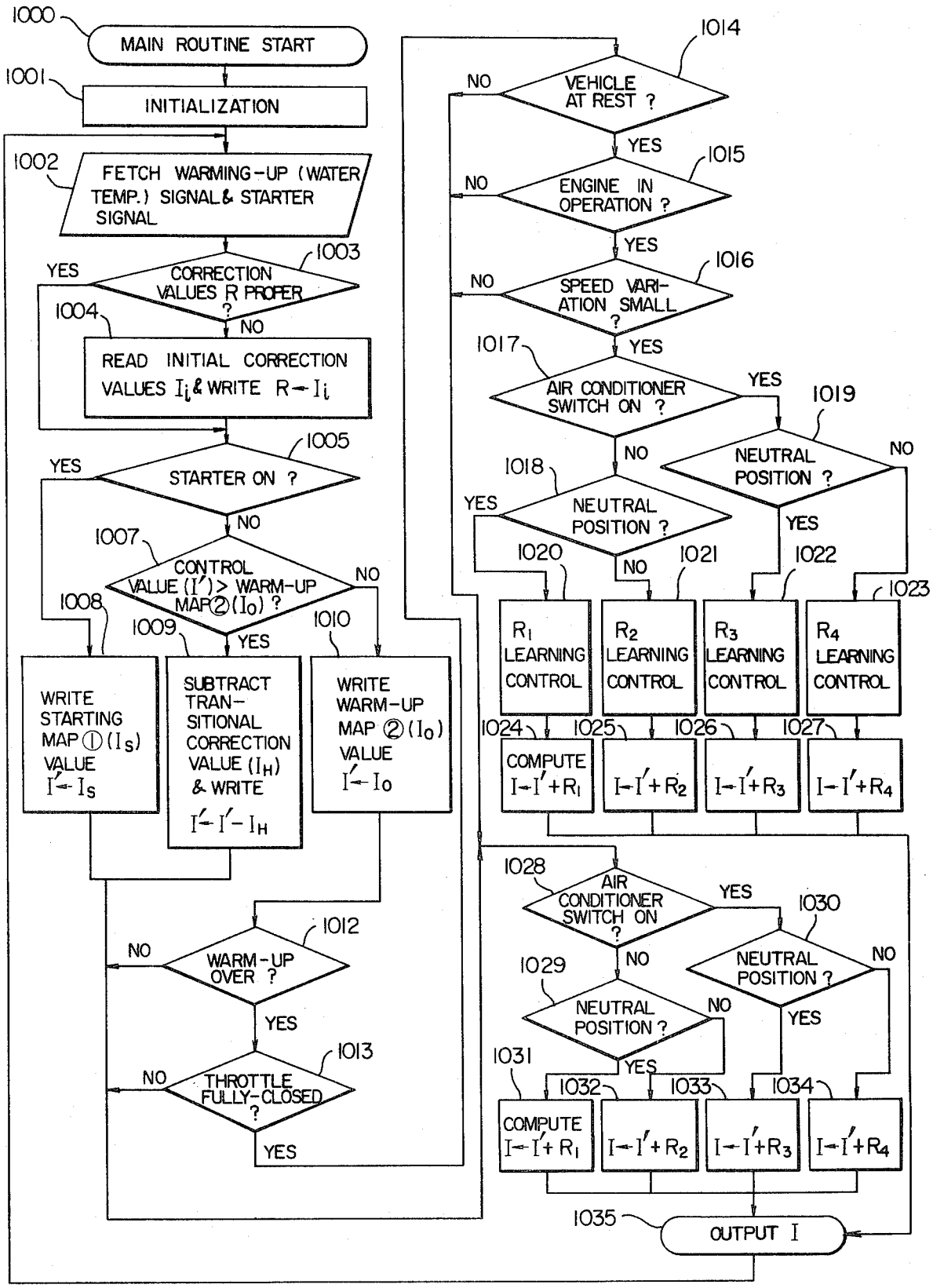
FIG. 3 is a flow chart showing the principal functions of the microprocessor shown in FIG. 2.

FIG. 3 is a simplified flow chart showing the idle air flow computing processing function of the microprocessor 100, and the function of the microprocessor 100 as well as the operation of the entire construction will be described with reference to the flow chart of FIG. 3. While, in this embodiment, a plurality of maps corresponding to different phases of the warm-up operation are used to provide a basic control variable for controlling the idle air flow as will be described later, the same control can be accomplished by using a plurality of different calculation formulas in place of these maps.

When the key switch 51 and the starter switch 41 are turned on so that the engine is started, the computing processing of a main routine is started by the start of a first step 1000, and a step 1001 performs an initialization operation such as the setting of starting address, etc., in the microprocessor 100. A step 1002 reads in a digital value corresponding to the cooling water temperature derived from the warm-up sensor 19 via the analog input port 104. A step 1003 determines whether the correction values R ($R_1$, $R_2$, $R_3$, $R_4$) stored in the RAM 107 are proper, that is, whether the correction values R are within a preset range of values. If the values are improper, the control is transferred to a step 1004 so that the correction values $R_1$ to $R_4$ in the nonvolatile memory 107 are respectively rewritten to predetermined initial correction values (fixed values) I ($I_1$, $I_2$, $I_3$, $I_4$). If the correction values R are proper or when the rewriting by the step 1004 is over, the control is transferred to a step 1005 which determines whether the starter of the engine is in operation, that is, whether the starter switch is on is determined in response to the signal from the starter switch 41. If the starter is in operation, a step 1008 derives from the warm-up map 1 of FIG. 5 (or the equivalent calculation formula) a basic control variable Is including a starting additional quantity as a control value I', and then steps 1028, 1029 and 1030 determine whether the air conditioner switch is on and whether the automatic transmission is at the neutral position thus determining the engine load condition. If there is a first engine load condition where the air conditioner switch is off and the transmission is at the neutral position, the control is transferred to a step 1031 so that the correction value $R_1$ corresponding to the first condition is read from the RAM 107 and an output control variable $I=I'+R_1$ is computed. This output is supplied to the D-A conversion unit 111 by a step 1035. If there exists a second engine load condition where the air conditioner switch is off and the transmission is at a non-neutral position, the control is transferred to a step 1032 so that a control variable $I=I'+R_2$ is computed and outputted. If there exists a third engine load condition where the air conditioner switch is on and the transmission is at the neutral position, the control is transferred to a step 1033 so that the correction value $R_3$ corresponding to the third condition is used to compute a control variable $I=I'+R_3$ and output it. If there exists a fourth engine load condition where the air conditioner switch is on and the transmission is at a non-neutral position, the control is transferred to a step 1034 so that the correction valve $R_4$ corresponding to the fourth condition is used and a control variable $I=I'+R_4$ is computed. This control variable is outputted by a step 1035. On the other hand, if the step 1005 determines that the starter is off, the control is transferred to a step 1007 which in turn determines whether the control value I' given by the preceding control variable is greater than the value Io of the warm-up map ② (the warm-up operation map) shown in FIG. 5 (or the equivalent calculation formula). If the control value I' is greater than the map value Io, a transional correction value $I_H$ is read from the ROM 108 and it is subtracted from the control value I'. The resulting value is used as the latest control value I' and in this way the control value I' is decreased gradually.

Thus, the control value I' obtained by the step 1009 is added together with the correction value corresponding to the load condition in the same manner as the control value obtained by the step 1008 when the starter was on and thus the desired control value I is obtained. In other words, the steps 1028 through 1034 add the correction value R ($R_1$, $R_2$, $R_3$ or $R_4$) corresponding to the engine load condition and the step 1035 delivers the corrected control variable I to the D-A conversion unit 111. If the step 1007 determines that the control value I' is less than the value Io of the warm-up map ②, a step 1010 selects the basic control variable or the value Io of the warm-up map ② as the control value I'. During the change-over from the warm-up map ① to ② the step 1009 performs the operation of subtracting the transitional correction value $I_H$ from the control value I' and in dependence on the magnitude of $I_H$ this operation is effected by repeating several cycles of the processing routine which returns from the steps 1028 through 1035 to the step 1002 and which will be described later, thus gradually decreasing the control value I'.

Steps 1012 to 1016 determine whether the engine is in the stable condition following the warm-up period. More specifically, when the control is transferred to the step 1012, it is determined whether the engine warm-up operation is over, that is, whether a predetermined water temperature has been exceeded is determined in accordance with the cooling water temperature data from the warm-up sensor 19. If the warm-up operation is over, the control is transferred to the step 1013 so that whether the throttle valve is at the fully-closed position or the throttle valve is at the idle position is determined in accordance with the signal from the throttle switch 43. If the throttle valve is at the fully-closed position, the control is transferred to the step 1014 so that whether the vehicle has no vehicle speed or whether the vehicle is at rest or in operation is determined in accordance with the signal from the vehicle speed sensor 44. If the vehicle is at rest, the control is transferred to the step 1015 so that whether the engine is in operation or at rest, that is, whether the engine speed Ne is higher than a predetermined value is determined in accordance with the output of the speed counter 101 or the engine speed (RPM) Ne signal. If the engine is not at rest, the control is transferred to the step 1006 so that whether the variation of the engine speed is less than a predetermined value or whether the difference between the current engine speed and the engine speed obtained a predetermined number of cycles or a predetermined period of time ago is less than a predetermined value is determined. If the variation of the engine speed is small, that is, when all the decision conditions of the steps 1012 through 1016 are satisfied and it is considered that the engine is at the idling operation and is operating stably, the control is transferred to a step 1017 so that whether the air conditioner switch 28 is on or whether the air conditioner compressor 26 is connected as an engine load is determined, and steps 1018 and 1019 each determines whether or not the transmission is at the neutral position in accordance with the signal from the vehicle automatic transmission neutral switch 42, that is, whether the transmission is not connected as an engine load is determined. If the air conditioner switch 28 is off and also the transmission is at the neutral position, that is, if there exists the first condition where both the air conditioner compressor and the automatic transmission are not operating as engine loads, the control is transferred to a step 1020 so that of the correction values R the correction value $R_1$ corresponding to the first condition is corrected and stored. In other words, the correction value $R_1$ is subjected to a learning control.

This learning control of the correction value $R_1$ will now be described with reference to the flow chart of FIG. 4. Firstly, a step 601 reads in a desired idling speed $N_1$ predetermined in correspondence to the first engine load condition, and a step 602 reads in the actual idling speed Ne. A step 603 computes the difference $\Delta N$ between the actual idling speed Ne and the desired idling speed $N_1$ or computes $\Delta N=Ne-N_1$. A step 604 determines whether the difference $\Delta N$ is positive. If it is positive, the control is transferred to a step 605 so that since the actual speed Ne is higher than the desired speed $N_1$, a predetermined correction value $\Delta I$ is subtracted from the correction value $R_1$ so as to decrease the actual engine speed or to decrease the idle air flow, and the resulting $R_1=R_1-\Delta I$ is stored as a new correction value $R_1$ in the RAM 107. If the difference $\Delta N$ is not positive, a step 606 determines whether the difference $\Delta N$ is negative. If it is, the control is transferred to a step 607 so that in accordance with the reverse logic to the operation of the step 605, a correction value $R_1=R_1+\Delta I$ is computed and this new correction value $R_1$ is stored in the nonvolatile memory 107. If the step 606 determines that the difference $\Delta N$ is not negative, the correction value $R_1$ is not rewritten. The details of the learning control processing step 1020 have been described so far. After the processing of the step 1020, the control is transferred to a step 1024 so that the new correction value $R_1$ is used to compute a control variable $I=I'+R_1$ $(=Io+R_1)$ and the resulting control variable I is applied by the step 1035 to the D-A conversion unit 1035.

If the steps 1017, 1018 and 1019 determine that there exists the second load condition where the air conditioner switch 28 is off and the automatic transmission is not at the neutral position but at the drive position, the control is transferred to a step 1021 so that of the correction values R the correction value $R_2$ is corrected and stored. This correction processing of the correction value $R_2$ by the step 1021 is effected in the similar manner as the step 1020 so that the computation of $R_2=R_1\pm\Delta I$ is effected in accordance with the difference between a desired idle speed $N_2$ predetermined in correspondence to the second engine load condition and the actual idling speed Ne and the correction is effected. Then, the control is transferred to a step 1025 so that the new correction value $R_2$ is used to obtain a control variable $I=I'+R_2$ and output it.

If the steps 1017, 1018 and 1019 determine that there exists the third load condition where the air conditioner switch 28 is on and the automatic transmission is at the neutral position, the control is transferred to a step 1022 so that of the correction values R the correction value $R_3$ corresponding to the third condition is corrected and stored. The correction processing of the step 1022 is also effected in the like manner as the steps 1020 and 1021 so that the computation of $R_3=R_3\pm\Delta I$ is effected in accordance with the difference between a desired idling speed $N_3$ corresponding to the third engine load condition and the actual idling speed Ne and the correction is effected. Then, the control is transferred to a step 1026 so that the new correction value $R_3$ is used to obtain a control value $I=I'+R_3$ and output it.

If the steps 1017, 1018 and 1019 determine that there exists the fourth load condition where the air conditioner switch 28 is on and the automatic transmission is not at the neutral position but at the drive position, the control is transferred to a step 1023 so that of the correction values R the correction value $R_4$ corresponding to the fourth condition is corrected and stored. The correction processing of the correction value $R_4$ by the step 1023 is effected in the like manner as the steps 1020, 1021 and 1022 so that the computation of $R_4=R_4\pm\Delta I$ is effected in accordance with the difference between a desired idling speed $N_4$ predetermined in correspondence to the fourth engine load conditon and the actual idling speed Ne and the correction is effected. Then, the control is transferred to a step 1027 so that the new correction value $R_4$ is used to obtain a correction value $I=I'+R_4$ and output it. In the present embodiment, the desired idling speed $R_4$ is selected to have the same value as the desired idling speed $N_2$ predetermined in correspondence to the second condition. Note that the correction values $R_1$, $R_2$, $R_3$ and $R_4$ and the initial correction values $I_1$, $I_2$, $I_3$ and $I_4$ which were described in connection with the step 1004 respectively correspond to the correction values $R_1$, $R_2$, $R_3$ and $R_4$ which were described in connection with the processes of the steps 1020, 1021, 1022. and 1023.

If the decisions of the steps 1012, 1013, 1014, 1015 and 1016 determine that the engine is at the warm-up operation, the throttle valve is open, the vehicle is in operation (the vehicle has a speed), the engine is at rest or the variation of the engine speed is large, that is, when it is considered that the engine is not in the steady state or idling operation, the control is transferred to the step 1028 and thus the correction processing of the correction values R ($R_1$, $R_2$, $R_3$, $R_4$) is not effected. The steps 1028, 1029 and 1030 perform the same processing as in the case of the correcting operations performed by the step 1008 during the starting period and by the step 1009 during the transitional period. More specifically, the steps 1031, 1032, 1033 and 1034 process in such a manner that the control variable I which determines the engine speed or the idle air flow is given by the predetermined basic control variable $I_o$ predetermined in corresponding to the engine warming conditions (the warm-up map ② of FIG. 5) and the correction value R ($R_1$, $R_2$, $R_3$ or $R_4$) given by the learning control processing of the step 1020, 1021, 1022 or 1023. Thus, no feedback control involving for example the detection of the deviation of the actual speed Ne from the desired speed is not effected.

When the processing of any of the steps 1008, 1009, 1024, 1025, 1026, 1027, 1031, 1032, 1033 and 1034 is completed and the resulting control variable is outputted by the step 1035, the control is returned to the step 1002 and the above-mentioned operations are repeated.

On the other hand, while the routine for computing the quantity of fuel injected from the fuel injection valves 16 (or the duration of injection) is well known in the art and will not be described in detail, the total air flow including the idle air flow supplied through the air control valve 30 is detected by the air flow meter 12 so that each time the interruption control unit 102 generates an interruption command in response to the air flow signal, the CPU 100 performs the computation of fuel injection quantity and the result of the computation is applied to the fuel injection duration controlling counter 109. Thus, the fuel injection valves 16 inject the fuel in an amount corresponding to the air flow.

While, in the above-described embodiment, the present invention is used in operating the engine equipped with the fuel injection system, the present invention can also be used with engines of the type equipped with a carburetor in which case the air control valve 30 may be replaced with an actuator for controlling the opening of the throttle valve and the operation of the actuator may be controlled in accordance with the control variable I in the like manner as described above.

Further, while, in the above-described embodiment, at least two different controlling maps are selectively used in response to different phases of the warm-up operation, it is possible to establish calculation formulas which provide the control data of the maps and effect the control through selective use of the calculation formulas.

Figure 5:
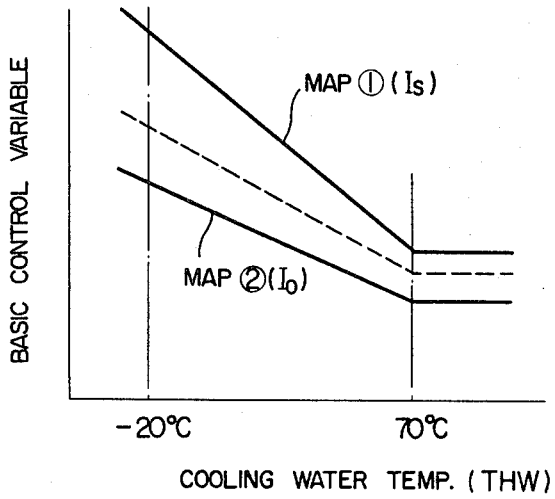
FIG. 5 is a characteristic diagram useful for explaining the invention.
Figure 6A:
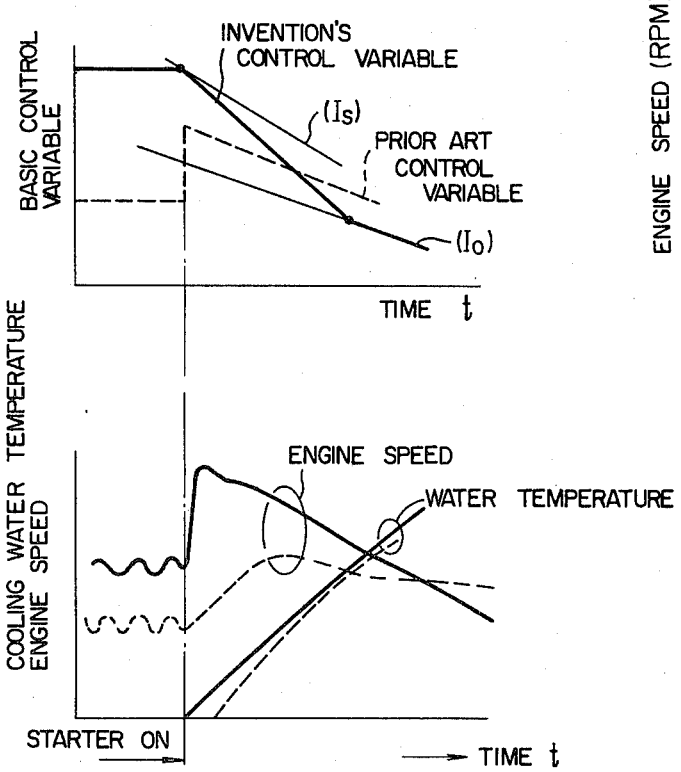
FIG. 6A is a diagram showing the variations with time of the control variable according to the invention.

From the foregoing it will be seen that in accordance with the invention there are provided a method and apparatus for controlling the idling speed of an engine during the starting and warm-up periods, which feature the use of two different basic control variable maps such as shown in FIG. 5 for controlling the air flow in accordance with the warming conditions of the engine such as the engine cooling water temperatures, whereby during the starting period of the engine the values corresponding to the warming conditions are derived from the first basic control variable map ①, while during the warm-up period the values corresponding to the warming conditions are derived from the second basic control variable map ②, and upon change-over from the map ① to the map ② the value from the map ① is gradually decreased at intervals of predetermined engine revolutions or a predetermined period of time to approach the value from the map ②, thus supplying the engine with the air flow corresponding to the warming condition of the engine during the starting period as shown by the solid-line characteristics of FIG. 6A according to the present invention and thereby improving the starting performance in comparison with the broken-line characteristics of the prior art.

Figure 6B:
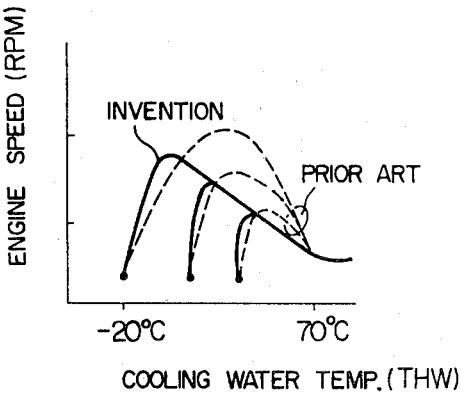
FIG. 6B shows an engine warm-up versus speed characteristic according to the invention.

In accordance with the solid-line characteristics of FIG. 6B showing the engine speed characteristics according to the invention, after the engine speed has increased and attained the peaks the engine speed is controlled in the same manner in accordance with the cooling water temperature. In accordance with the broken-line characteristics of the prior art method, however, after the engine speed has increased sufficiently the engine speed is not controlled in the same manner in accordance with the cooling water temperature. In other words, as compared with the prior art control during the warm-up period in which the opening of the air control valve is controlled by preparing a one kind of map only in accordance with the engine warming conditions, the introduction of the map change-over operation and the decremental control at intervals of a time upon change-over ensures a greater degree of freedom with the resulting great advantage of ensuring easy adaptation of the engine speed to the warming-up operation in accordance with the warming conditions of the engine and thereby improving the fuel consumption during the warm-up period.

We claim:

1. In a method of controlling an idling speed of an internal combustion engine in accordance with a basic control variable preliminary established for controlling an idle air flow so as to maintain the idling speed at a rate corresponding to a warming condition of the engine, the improvement including:

selectively using at least two different supply sources for supplying said basic control variable in accordance with engine conditions and load conditions of said engine, wherein said supply sources include at least a first basic control variable supply source for engine starting purposes and a second basic control variable supply source for warming up purposes, and wherein upon change-over between said sources, said control variable obtained in accordance with said first source is decreased by a predetermined value every predetermined interval such that when said control variable becomes smaller than one obtained in accordance with said second source, said control variable is varied in accordance with said second source.

2. A method according to claim 1, wherein said decrease by a predetermined value is made at intervals of a predetermined time period.

3. A method according to claim 1, wherein said supply sources include at least a first basic control variable supply calculation formula for engine starting purposes and a second basic control variable supply calculation formula for warming up purposes.

4. A method according to claim 1, wherein during an idling operation after said engine has warmed up sufficiently, in accordance with the differences between desired idling speeds preliminarily established in correspondence to operating conditions of said engine and the actual idling speeds thereof correction values of said basic control variable which are required to reduce the differences between said actual idling speeds and said desired idling speeds to zero are computed and stored, whereby under all the operating conditions of said engine including said idling operation said basic control variable supplied in accordance with said supply sources is corrected in accordance with said correction values (R) so as to adjust said idle air flow.

5. An engine idling speed control apparatus for an automobile having an air-conditioner, comprising:

sensor means, including a starter operation sensor, automatic-transmission operation sensor, engine warm-up-sensor and air-conditioner operation sensor, for generating signals indicating engine operating conditions;

electronic control means, responsive to said signals, for generating a first signal to instruct an amount of injected fuel and generating a second signal to instruct an amount of correcting air-flow to the engine; and means for controlling the amount of injected fuel according to the first signal and means for controlling the amount of air-flow to the engine according to the second signal;

wherein said electronic ciontrol means includes at least two kinds of function means each defining the second signal variable as each predetermined function of change of at least one of said sensor generating signals, and wherein said electronic control means includes a central processor unit for calculating out the first and second signals in response to said sensor generating signals, first source means defining the second signal for engine starting condition, second source means defining the second signal for engine warming-up condition, and means for discriminating engine starting and warming-up conditions from said sensor signals to select the corresponding one of said source means.

6. An apparatus according to claim 5, wherein said electronic control means includes first storage means for storing a correction value of the second signal predetermined in correspondence with signals generated by the automatic-transmission operation sensor and air-conditioner operation sensor which represent an engine load condition, a second storage means for storing a desired idling speed indicating value in corresponding to an engine load condition, means for modifying the correction value to reduce difference between the desired idling speed and actual idling speed sensed by said speed sensor, and means for updating the corresponding second signal by the modified correction value.

* * * * *